US010087593B2

(12) United States Patent
Krogenes

(10) Patent No.: US 10,087,593 B2
(45) Date of Patent: Oct. 2, 2018

(54) RAPID DEPLOYMENT FLOOD BARRIER

(71) Applicant: Diluvium Flood Barriers LLC, Dover, DE (US)

(72) Inventor: Helge Krogenes, Duken (NO)

(73) Assignee: Diluvium Flood Barriers LLC, Bellevue, WA (US)

( * ) Notice: Subject to any disclaimer, the term of this patent is extended or adjusted under 35 U.S.C. 154(b) by 124 days.

(21) Appl. No.: 15/089,410

(22) Filed: Apr. 1, 2016

(65) Prior Publication Data

US 2016/0289908 A1 Oct. 6, 2016

Related U.S. Application Data

(60) Provisional application No. 62/142,724, filed on Apr. 3, 2015.

(51) Int. Cl.

| | |
|---|---|
| ***E02B 3/10*** | (2006.01) |
| ***E02B 7/00*** | (2006.01) |
| ***E02B 7/02*** | (2006.01) |

(52) U.S. Cl.

CPC ..... *E02B 3/106* (2013.01); *E02B 3/10* (2013.01); *E02B 7/00* (2013.01); *E02B 7/02* (2013.01)

(58) Field of Classification Search

CPC ..... E02B 7/00; E02B 7/02; E02B 3/10
USPC ..... 405/91, 98, 109–110, 112–115
See application file for complete search history.

(56) References Cited

U.S. PATENT DOCUMENTS 2,128,657 A * 8/1938 Madaras ..... E02B 7/08 405/113
6,079,904 A * 6/2000 Trisl ..... E02B 3/106 405/107
6,142,704 A 11/2000 Coyne
6,692,188 B1 * 2/2004 Walker ..... E02B 3/106 210/162
6,726,405 B1 4/2004 Rorheim
7,121,764 B2 10/2006 Rorheim

FOREIGN PATENT DOCUMENTS

| | | | |
|---|---|---|---|
| AU | 6988898 | A | 12/1999 |
| AU | 9869888 | A * | 12/1999 |
| DE | 29721363 | U1 | 2/1998 |
| EP | 1174544 | A2 | 1/2002 |
| WO | WO 2002/092918 | A1 | 11/2002 |

OTHER PUBLICATIONS

International Patent Application No. PCT/US2016/025745; Int'l Search Report and the Written Opinion; dated Aug. 3, 2016; 12 pages.
Canada Patent Application No. 2989402; Office Action; dated Feb. 5, 2018; 4 pages.

* cited by examiner

*Primary Examiner* — Sunil Singh
(74) *Attorney, Agent, or Firm* — Baker & Hostetler LLP

(57) ABSTRACT

A reusable flood barrier that may be easily collapsed and deployed is disclosed. The barrier may comprise a flexible sheet, a plurality of parallel wall support members, a plurality of parallel base support members, a limiter configured to hold the wall up relative to the base in an erected configuration, and a hinge. After closing the barrier at the hinge, the barrier may be rolled up for easy portability and storage. The barrier is flexible, and while erected it can bend to form convex or concave curves in the barrier wall to enable construction of a flood barrier that goes around corners.

21 Claims, 10 Drawing Sheets

RAPID DEPLOYMENT FLOOD BARRIER

CROSS REFERENCE TO RELATED APPLICATIONS

This application claims benefit under 35 U.S.C. § 119(e) of Provisional U.S. Patent Application no. 62/142,724 filed on Apr. 3, 2015, the contents of which is incorporated herein by reference in its entirety.

TECHNICAL FIELD

This disclosure relates to the fields of portable flood protection and water retention.

BACKGROUND

Flood barriers prevent invading water on a flooding side of the barrier from reaching a protected side of the barrier. They are used where flooding waters occasionally occur, such as an area subject to an occasional unusually high tide, a storm surge, a springtime swollen river, or anywhere a flood may occur.

A good flood barrier has several attributes. A flood barrier must generally be high enough to prevent water (or other flooding fluid) from breaching or cresting above the top of the barrier, and it should be sufficiently sealed or waterproof enough to allow only an amount of water through the barrier that is negligible for the application at hand. Perhaps less obviously, the barrier should be strong enough to withstand the substantial horizontal force from a standing or even surging water body on the flooding side of the barrier. It must withstand this force without bursting or even just sliding laterally toward the protected side of the barrier.

Traditional flood barriers include large permanent installations, such as levees or dikes, and may consist simply of a large mound of dirt or of concrete and steel walls. In areas where flooding is less frequent, a flood barrier may preferably be non-permanent, such that it can be deployed when a flood is threatened and removed once the threat is gone. Such deployable barriers can be used for infrequent flooding threats, for example, to protect a single building in a town where a permanent levee may fail, or to protect an area from the unexpected flooding from a town's water main pipe break. A common deployable flood barrier is a simple pile of sand bags.

FIG. 1 depicts a more sophisticated prior art removable flood barrier, as presented in U.S. Pat. No. 7,121,764. As depicted in FIG. 1, the prior art barrier 1 includes a solid wall 5, a solid support plate 13, and a gasket 12. The solid wall 5 and solid support plate 13 are large and heavy, making storage and installation a challenge. Additionally, gasket 12 must be included to provide an effective seal against flooding water and may be 2" or more thick. The gasket 12 requires pressure prior to flooding, which in FIG. 1 is provided by sandbag 14.

SUMMARY

A flood barrier is disclosed comprising: a wall including a flexible sheet and a plurality of parallel wall support members; a base including a flexible sheet and a plurality of parallel base support members; a hinge connecting the base to the wall; and wherein the flood barrier provides flood protection when in an erected configuration, and wherein the flood barrier is capable of closing to a collapsed configuration by bending at the hinge.

BRIEF DESCRIPTION OF THE DRAWINGS

A more detailed understanding may be had from the following description, given by way of example in conjunction with the accompanying drawings wherein.

DETAILED DESCRIPTION OF ILLUSTRATIVE EMBODIMENTS

This disclosure presents a rapidly deployable flood barrier. The presented flood barrier collapses and may be rolled into a small and light-weight roll for easy storage and simplicity of deployment. It is flexible, and while erected it can bend to form convex or concave curves in the barrier wall to enable construction of a flood barrier that goes around corners. The presented barrier need not be customized for a particular location, and is reusable and repurposeable to other locations.

The primary material of the barrier may be a waterproof and flexible material such as PVC (polyvinyl chloride). Materials such as PVC enable the barrier to be folded or rolled up. The weight of water itself can help create a watertight seal, and the force from the water weight, to some extent, adds to the stability necessary to prevent the barrier from sliding horizontally toward the protected side of the barrier. Stiff battens and rods keep the barrier erect prior to arrival of the water. Flexible wires give the barrier strength to hold the barrier wall against the substantial horizontal force from flooded water. When flooded, the weight of the flooding liquid itself can help seal the flexible material of the base to the ground or floor beneath the base.

Figure 1:
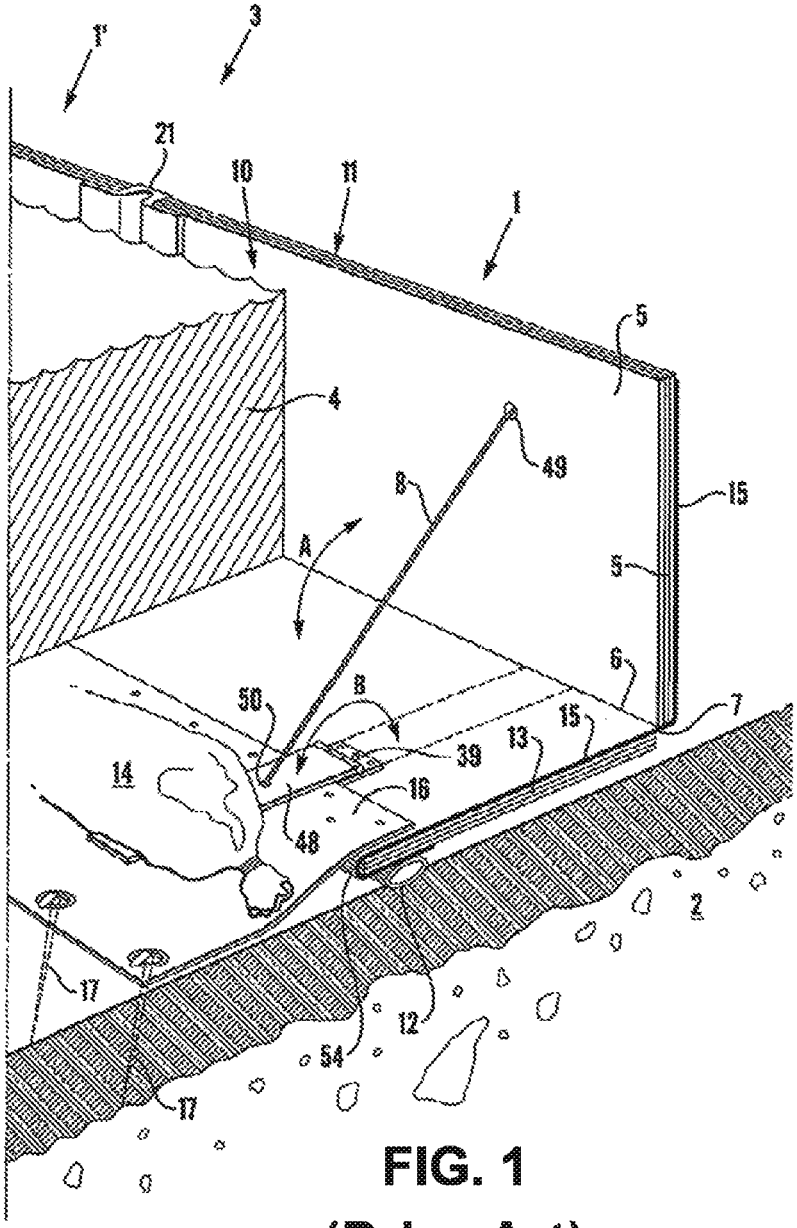
FIG. 1 (Prior Art)
FIG. 1 is an illustration of the PRIOR ART flood barrier of U.S. Pat. No. 7,121,764.
Figure 2:
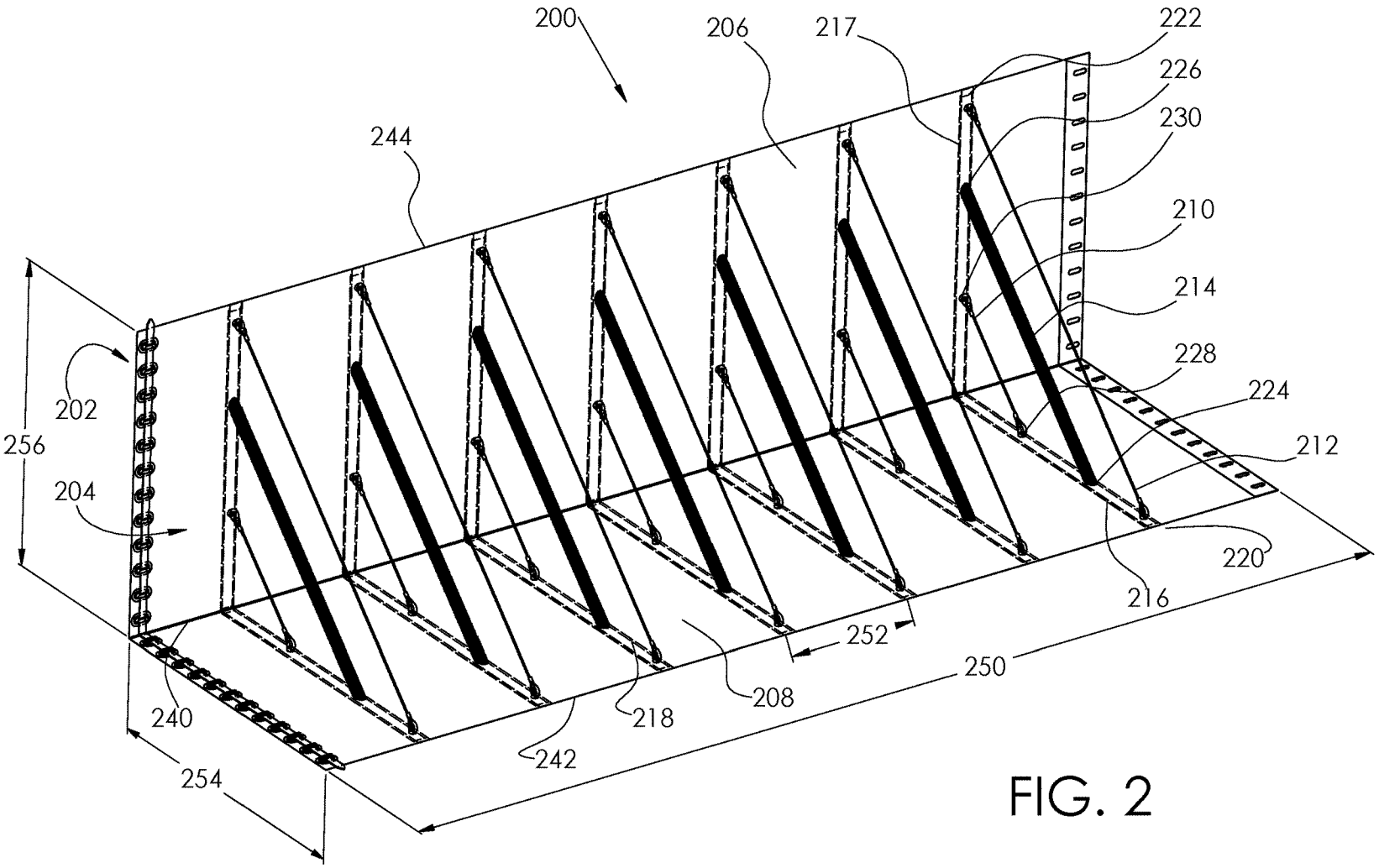
FIG. 2 is an illustration of an exemplary flood barrier in a straight erected configuration.

FIG. 2 is an illustration of an exemplary flood barrier, erected and in a straight configuration. When erected, the flood barrier 200 provides protection to a protected side 202 from a flooding fluid on the flooding side 204. The flood barrier 200 includes a wall 206 and a base 208 which are connected at hinge 240. The wall 206 and base 208 may comprise a flexible sheet material with low water permeability that is resistant to stretching, such as PVC. Battens 217 are embedded in the wall 206 which add stiffness to the wall 206 along the length of the battens 217. For example, as depicted in FIG. 2, the parallel vertical battens 217 may at as wall support members by helping to prevent the flexible sheet of wall 206 from folding over on itself prior to flooding. Base 208 also includes embedded battens 216. Stiff rods 214 act as a limiter to help hold up the wall prior to flooding, and after flooding, both rods 214 and wires 210 and 212 act as a limiter to help counteract the horizontal force of the water. Bolt holes (not depicted) enable bolting the flood barrier to the ground beneath the base 208.

The battens 216 and 217 may be long and thin, and may be arranged parallel to each other along the length 250 of the barrier 200. The battens 216 in the base 208 each extend from the hinge 240 to the front edge 242, and the battens 217 each extend from the hinge 240 to the top edge 244. Dimensions of individual battens for a barrier 200 height 256 of 4' may be 5 cm wide and 5 mm thick. Battens 216 and 217 may be made of a wide variety of materials, but strong and light materials such as fiberglass or wood or aluminum may be preferred. The battens 216 and 217 may be uniformly spaced across the length 250 of the barrier; for example, spacing 252 may be from 10 to 40 cm. A narrower spacing width and more than two wires per batten may be preferred for use in extreme conditions, while a wider spacing and only one or two wires may be preferred for comparably ordinary flooding conditions. A narrower spacing and more wires may increase the overall strength of the barrier 200.

The sheet materials of the wall 206 and base 208 can be of the same material, but need not be. Desirable properties of the sheet material itself include low water permeability, strength, abrasion resistance, light weight, and low cost. PVC of 900 to 1250 grams per square meter is an example material that may meet these requirements. Also important is the existence of methods for both temporarily and permanently sealing the sheet to itself in a strong and water tight seal. A permanent seal method may be preferable for creating the batten pockets, while a temporary seal method may be preferable to seal the ends of the barrier 200 to a neighboring barrier. By sealing the ends of neighboring barriers together, a longer combined barrier can be created. An exemplary seal between neighboring barriers is described below regarding FIGS. 8-10.

If the material of the wall 206 and base 208 are made of the same material, a single continuous sheet may be used for both wall and base with simply a bend at the hinge 240. A continuous sheet may simplify the method of ensuring water-tightness at the hinge 240. In such an embodiment, hinge 240 may be nothing more than a bend in the continuous sheet material where battens 216 and 217 meet (or come close to meeting). Or, alternately, other hardware may define the hinge, such as movable joints connecting the vertical battens 217 to the horizontal battens 216.

Alternately, the sheet material of the wall 206 and base 208 may separate sheets that are sealed together at the hinge. Many methods of sealing are possible, with the seal preferably being both strong and resistant to leaking. One method of sealing separate sheets at the hinge uses a three-sheet PVC hinge overlapping and connected with a lock fastened with a high strength band which will press the sheets together and provide a non-permeability seal.

The battens 216 and 217 may be embedded in the sheet material of wall 206 and base 208 by various means such as by creating a pocket in the sheet in the way battens are held in the sail of a sailboat. Two sheets can be overlapped and sealed together at two points, leaving a gap between the two sealed points just larger than the width of the batten. This creates a pocket between the two sheets that a batten can be slid into. The seal mechanism between the sheets may depend on the material of the sheets. For PVC material, chemical or heat welding can be used. In other embodiments stitching may be used. The battens may be loose in the pockets, or secured to the sheet material, for example by melting or welding. Battens loose in their pockets may be preferable to allow the pocket to dry after use as a barrier in a flood. A batten loose in its pocket may still be held firmly in place when the system is erected by the wires 210 and 212 and by rods 214.

Wires 210 and 212 may tether wall 206 to base 208. They provide strength to help withstand the pressure from water on the flooded side 204 of wall 206 when there is no counteracting force from the protected side 202 of wall 206. When flooded, the vertical downward force from the water itself presses down on the base 208, provided at least 6" of the base 208 near where the base 208 joins the wall 206 is relatively flat against the ground, sealing it to the ground beneath the base, and also helps provide the force at the bottom ends of wires 210 and 212 to resist the tension at the top end caused by the horizontal force from the water. As depicted here, the wires are connected at points along the base 208 and wall 206 where a batten is located. The wires 210 and 212 may be connected through one layer of sheet material and directly connected to the battens 216 and 217 themselves for additional stability rather than connecting the wires 210 and 212 only to the sheet material itself. In this case, wires will go through sheet material and battens and have a washer and fastener on the backside of the sheet material providing a water seal when pressure from the flood water are applied. As depicted in FIG. 2, there are two wires, 210 and 212, per batten connected to the base 208 at points 228 and 220, respectively, and connected to the wall 206 at points 230 and 222, respectively. Other arrangements are possible with more or fewer wires. For example, when the height 254 of the flood barrier is taller, more wires may be used; when the barrier is shorter, fewer wires may be used to connect along the width 254 of the base 208 and along the height 256 of the wall 206. The material of the wires may preferably have high tensile strength and be resistant to corrosion from the expected flooding fluid. The wire material may be metal or other types of string, and may be woven or braided for strength and durability.

The rods 214 are connected to the base 208 and wall 206 at points 224 and 226, respectively, and when erected, the rods 214 in this embodiment are co-planer with the wires 210 and 212. The rod 214 and wires 210 and 212 are all connected to the same battens 216 and 217. When erected, the wires 210 and 212, and rod 214 may all be parallel to each other, all of which may be at a 45 degree angle to the base 208 and 45 degree angle to the wall 206, with the wall 206 at a 90 degree angle to the base 208. Other angles are possible. For example, rod 214 may connect to the wall 206 at the same point as outer wire 212, while rod 214 and wire 212 still connect to the base 208 at different points. In this alternate embodiment, points 222 and 226 would be the same point. An embodiment with rod 214 more vertical than 45 degrees when erected may be preferable to prevent rod 214 from extending beyond front edge 242 when the barrier 200 is collapsed as in FIG. 4.

The rods 214 may be permanently connected to the base at point 224 in a hinged joint, while the rods may be capable of being disconnected and reconnected to wall 206 at point 226 when erecting or collapsing the barrier 200. Alternately, both ends of rod 214 could be capable of temporary connections at both points 224 and 226. A temporary connection can be made with a splint nut and a washer. The end of the rod can poke through the wall 206, a nut on the protected side 202 of the wall holds the rods 214 in place, and the pressure from flooded water on the washer seals the hole that the end of the rods 214 pokes through. Other temporary attachment mechanisms are possible. The rods 214 may act as an angle support members in that they help to hold the wall at a desired angle relative to the base. The material of the rods 214 may preferably be stiff enough to hold the wall 206 up prior to flooding. A wide variety of rod materials are possible, such a fiberglass, wood, metal, or plastic.

While both rods and wires may act as limiters to hold the wall up before and after flooding, other limiter means for holding up the wall are possible. For example, the hinge may include a limiting mechanism to prevent opening beyond a desired angle.

The barrier 200 may be bolted to the ground or otherwise secured from, for example, strong storm winds. Bolting the barrier 200 to the ground may instead help prevent an erected barrier from tipping over before or after flooding; sliding horizontally prior to flooding from, for example, strong storm winds; and sliding horizontally after flooding due to horizontal force on the wall 206 from standing water pressure and any water surge. However, in the absence of wind, bolting may not be necessary.

Bolt holes (not pictured) in the area 218 at the ends of battens can provide a connection point to bolt the barrier 200 to the ground. For example, a flap of sheet material of the base 208 may extend out from front edge 242 at the end of every batten pocket. The flap may contain a bolt hole that may be reinforced with a ring of, for example, high-strength plastic or light-weight metal. Such a simple bolt hole can be used with a variety of bolts. A bolting mechanism that functions with a variety of bolting mechanisms may be preferable to enable bolting to a variety of different types of ground or floor that may be beneath the base 208. The flap of sheet material may be an extension of the sheet material used to form the batten pocket which may be formed on the underside of base 208. Such an extension of the batten pocket material may also extend at the hinge 240 from either of the batten pockets for battens 216 or 217. Such an extension at the hinge 240 with a bolt hole may provide additional means for bolting the barrier 200. Other methods for fixing the barrier 200 to the ground underneath the base 208 are possible. For example hooks, or tie-stays, or other similar means may be used. These fixing means may be attached at the underside of base 208, along the hinge 240 and/or front edge 242, or may also be attached to the wall 206. Other bolt configurations may be used; for example, multiple bolts per batten, or only one bolt for every several battens. No bolts may be needed for installation in locations that flood without excessive wind.

The flood barrier 200 may be constructed in many lengths, but the length need not be matched to any particular application. A complete flood barrier for a protected space may comprise several identical barriers such as barrier 200, all connected end-to-end with a watertight seal. As described above for a seal at the hinge 240, a preferable seal may be strong and resist leaking. Such a seal may consist of a three finger overlap, with a through-bolt, and a flat locking band connecting the flaps tightly together to preventing leakage. Other seals are possible, such as a waterproof zipper. The connected barriers may form a complete loop around the protected space, or be connected at the ends to a permanent structure of some sort that will act as a flood barrier, such as a concrete wall or the side of a building. As depicted in FIG. 2, a flood barrier 200 may have a length 250 of 30', a height 256 of 4', and a width 254 of 4'. Other dimensions are possible, and the height 256 and width 254 need not be identical. A height 256 less than width 254 may be preferable for more stability when flooded.

Figure 3:
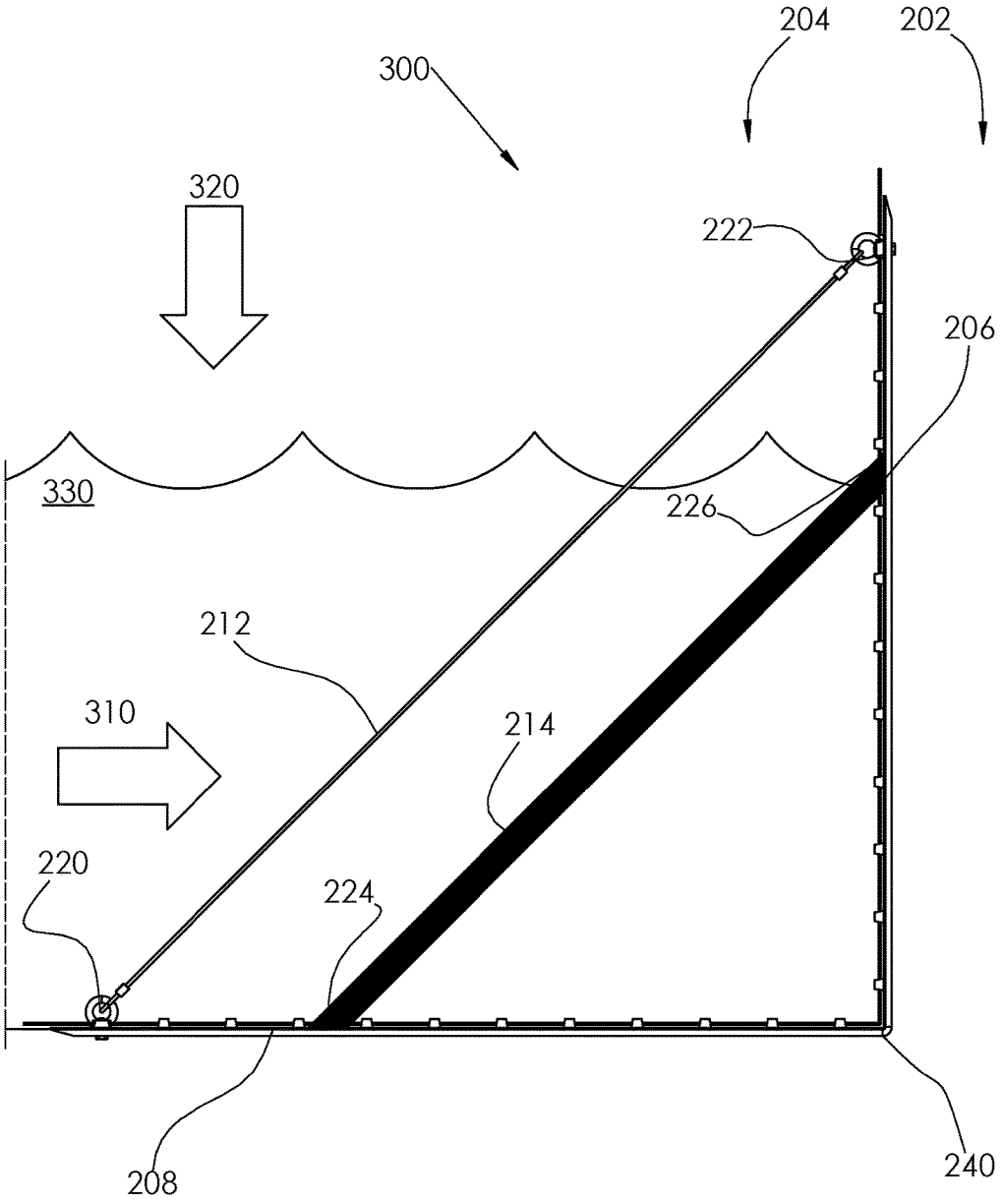
FIG. 3 is a side view schematic of an exemplary flood barrier in an erected configuration.

FIG. 3 is a schematic side view of an exemplary flood barrier in an erected configuration. Flood barrier 300 has only one wire 212 alone with rod 214. Wire 212 connects wall 206 to base 208 at points 222 and 220, respectively, while rod 214 connects at 224 and 226. Wall 206 and base 208 are connected at hinge 240. Protected side 202 is protected from water 330 on the flooding side 204 by flood barrier 300. The weight of water 330 creates horizontal force 310 on the wall 206, and vertical force 320 on the base 208.

Figure 4:
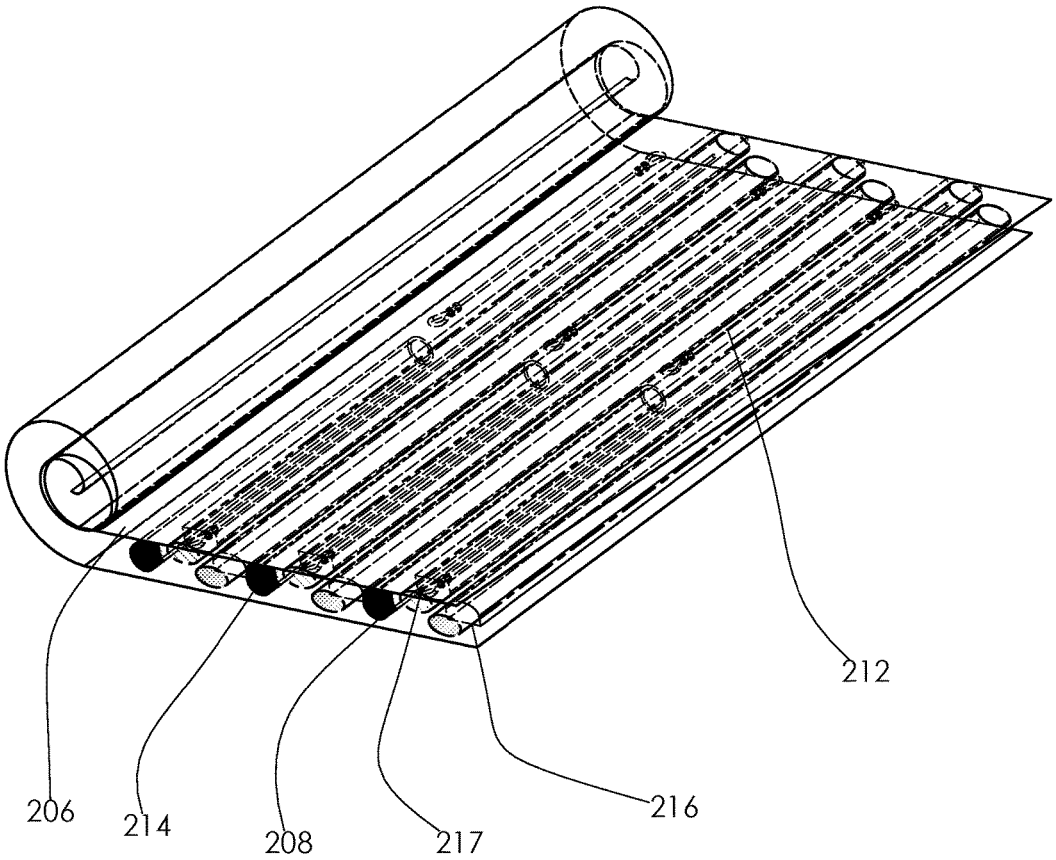
FIG. 4 is an illustration of an exemplary flood barrier in a collapsed configuration.

FIG. 4 is an illustration of an exemplary flood barrier in a collapsed configuration. To collapse (or close) the barrier, first any ground bolts are removed and the rods 214 are detached at one or both ends. Then the wall 206 is simply folded down at the hinge until it lies on top of the base 208. Battens 216 and 217 may remain in their pockets in the base 208 and wall 206. The rods 214 and wires 212 may remain in between the base 208 and collapsed wall 206. Once flattened together, the entire barrier may be rolled up.

Figure 5:
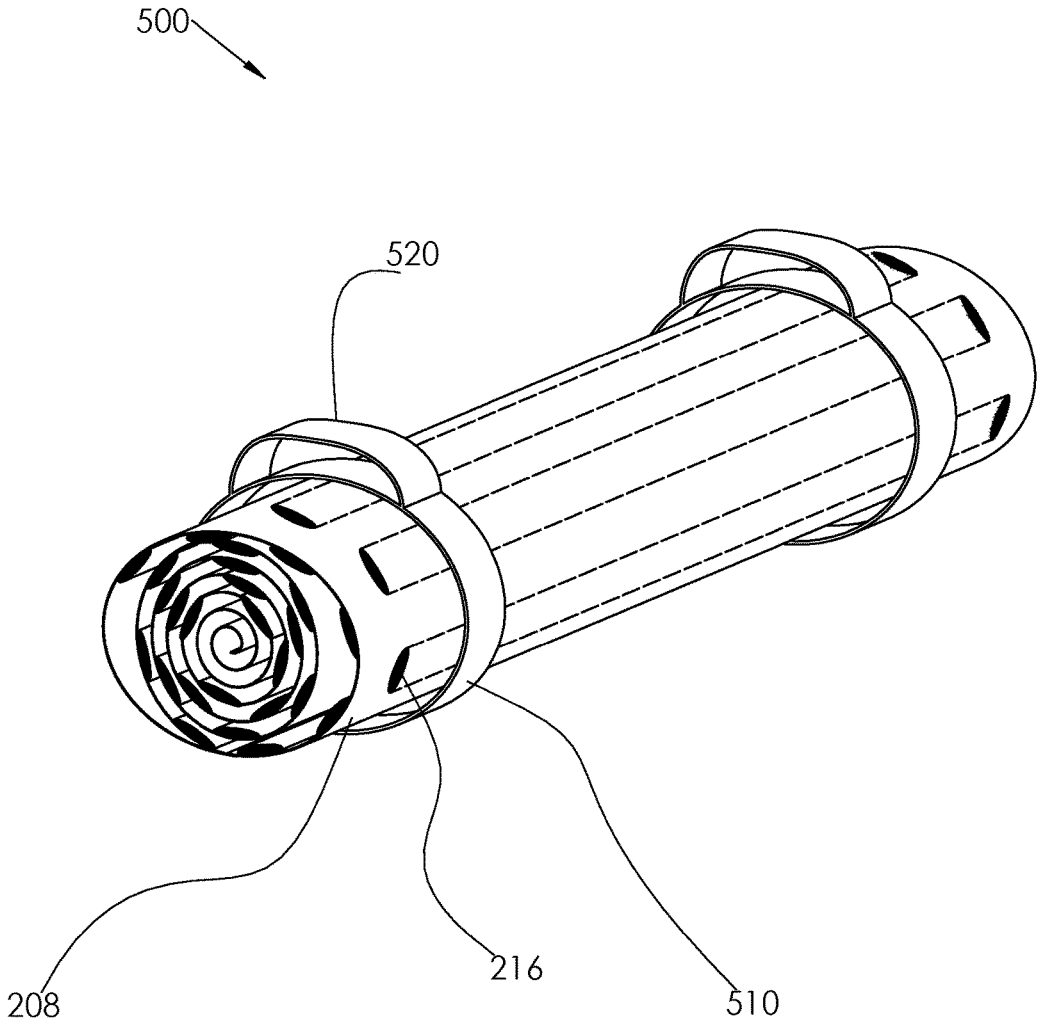
FIG. 5 is an illustration of an exemplary flood barrier in a rolled configuration.

FIG. 5 is an illustration of an exemplary flood barrier in a rolled configuration. As depicted, the bottom of base 208 forms the outside of the rolled barrier 500, with battens 216 still embedded inside the base 208. After rolling, ties 510 can be wrapped around the rolled barrier to secure the barrier in a tightly rolled and hence more easily transported configuration. Ties 510 may include integrated handles 520 to more easily carry the rolled barrier 500. The ties may be permanently affixed to an end of the base 208 to prevent loss while erected, and may also simplify securely tying up the roll. The material for the ties 510 may be the same material as used for the sheet of wall 206 and base 208. When manufactured of sufficiently light materials, barrier 500 with a height of 4' and length of 30' may be easily carried and deployed by just two people.

Deploying a rolled barrier 500 is a reverse of the above process. The roll is positioned at one end of the area where the flood barrier is desired to be erected. The ties 510 are released, and the barrier 500 is unrolled. The barrier is opened by lifting the wall off the base, and the rods are affixed to both the wall and the base. After any final positioning relative to the ground or other surrounding structures such as a neighboring barrier, the ground bolts are attached.

Figure 6:
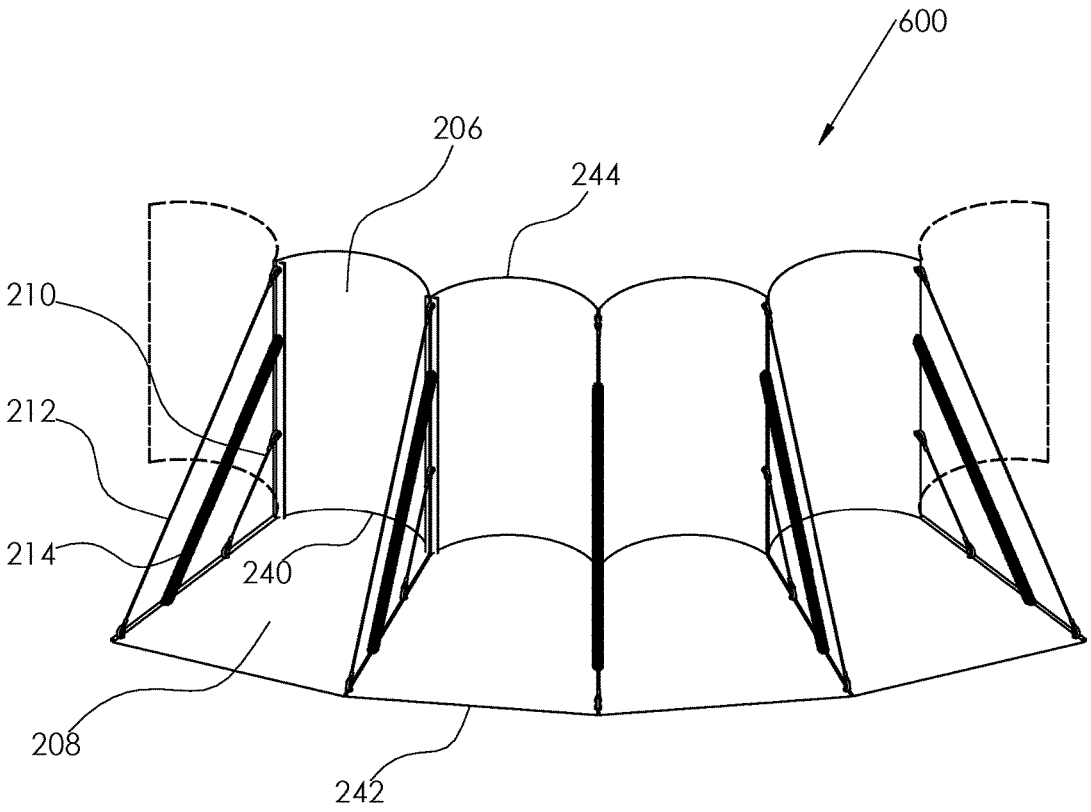
FIG. 6 is an illustration of an exemplary flood barrier in an erected concave curve configuration.
Figure 7:
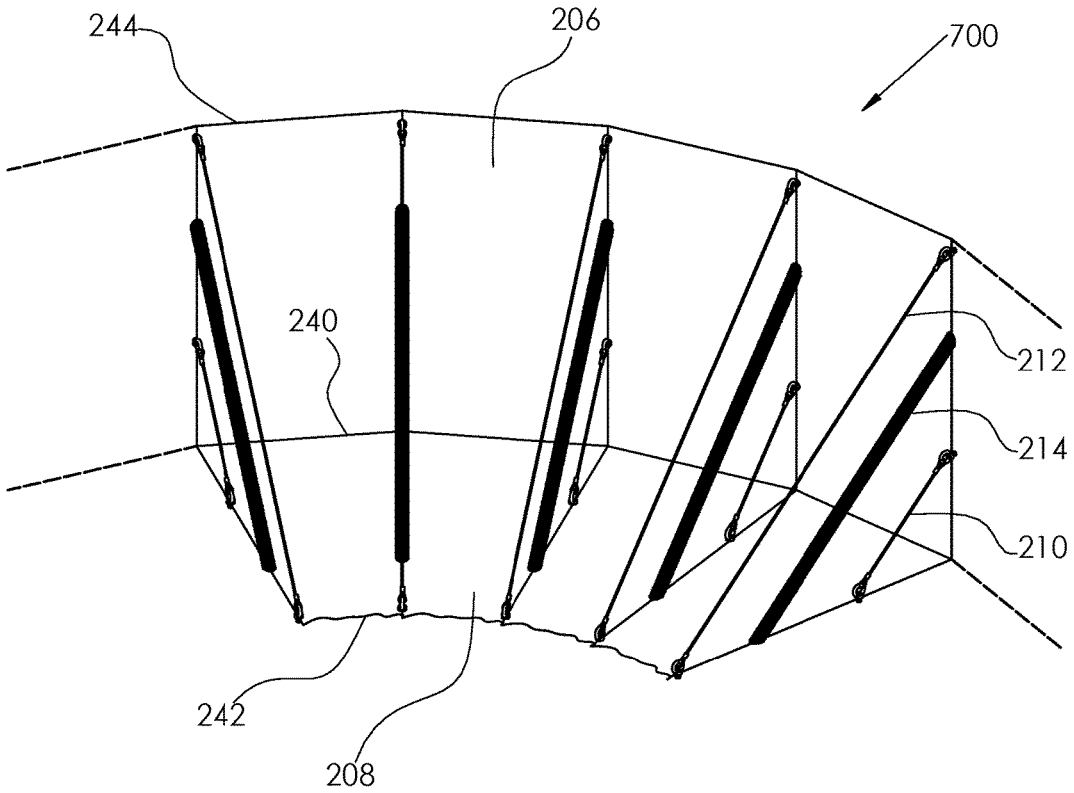
FIG. 7 is an illustration of an exemplary flood barrier in an erected convex curve configuration.

A straight barrier such as barrier 200 of FIG. 2 can be deployed as a curved barrier so as to curve around dimensional objects, such as buildings, streets, docks, piers, riversides, etc. FIG. 6 is an illustration of an exemplary flood barrier in an erected concave curve configuration. FIG. 7 is an illustration of an exemplary flood barrier in an erected convex curve configuration. In the concave curve of FIG. 6, the front edge 242 of the flooded side is taut, while the entire wall 206 is slack with extra sheet material between the battens. This means both the top edge 206 and the hinge 240 are also slack with extra sheet material. Extra sheet material in the base 208 may prevent a sufficient seal from forming between the base and the ground below the base. However, as long as a sufficiently wide strip of contiguous sheet material is not buckling or bubbling, a sufficient seal may still be created by the downward pressure from flooded water. The width of the battens limit how close the vertical battens 217 can get to each other, which will also limit the amount of slack sheet material at hinge 240. Just 6" (of the 4' total) of flat sheet material near front edge 242 may form a sufficient seal between base 208 and the ground below it.

The abundance of extra base material (the 3'6" extra material in the example above) provides redundancy in the seal between the base and the ground. This extra width in the seal, in addition to providing a seal despite bubbling at one edge, also enables a barrier in a straight configuration as in FIG. 2 to provide a complete seal despite irregularity in the ground beneath the base 208, such as small holes or lumps in ground that is not flat. Larger holes may require filling in with clay or sandbags prior to erection of the barrier.

The convex curve configuration in FIG. 7 has the reverse of the curve of FIG. 6. In FIG. 7 the wall 206, upper edge 244, and hinge 240 are all taut, while the front edge 242 has loose material and may bubble. As in the concave curve of FIG. 6, as long as a sufficient portion of sheet material remains flat in the base 208 near the hinge 240, a sufficient seal may be created.

Figure 8:
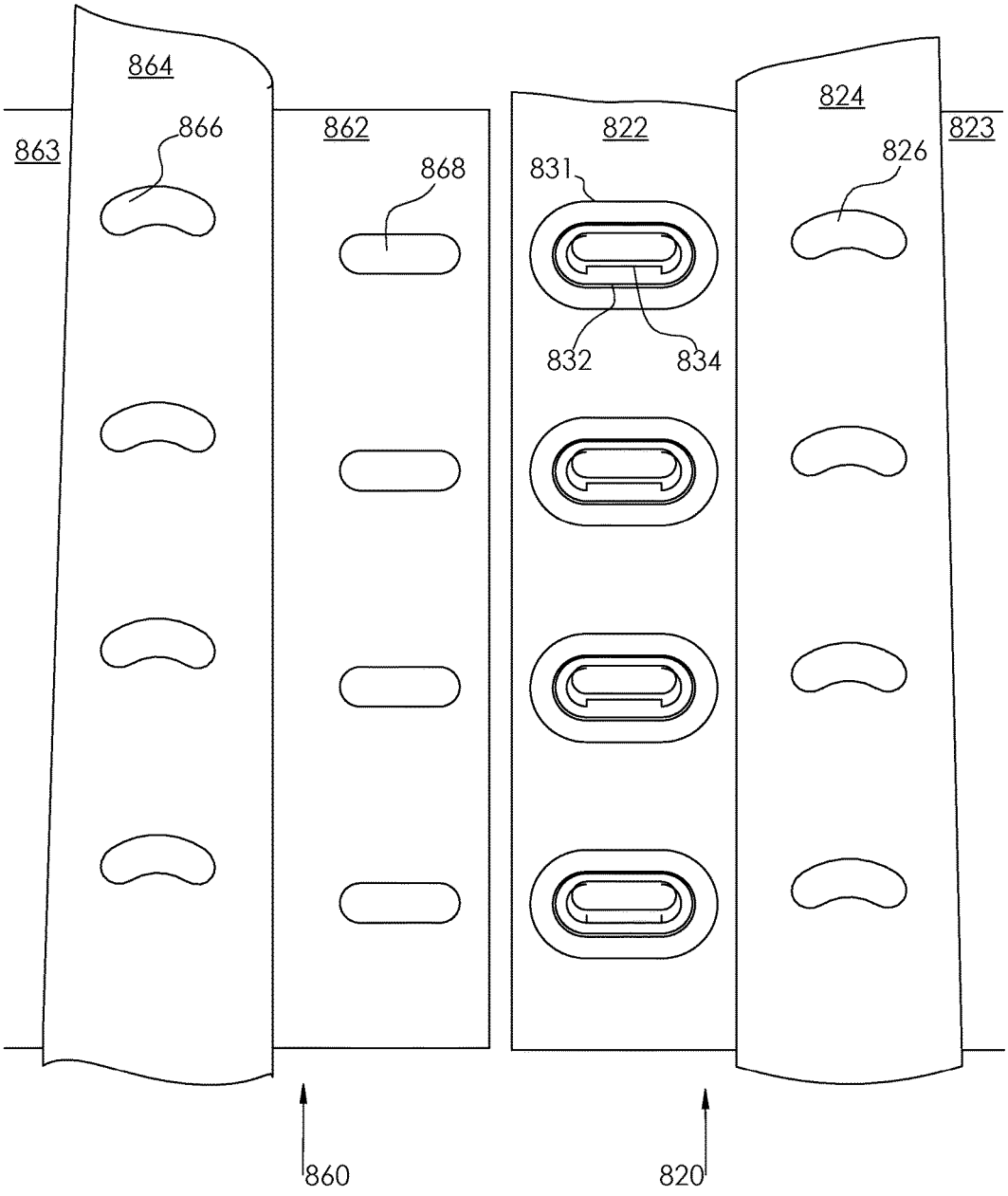
FIG. 8 is an illustration of exemplary ends of two flood barriers before connecting the flood barriers in a seam.
Figure 9:
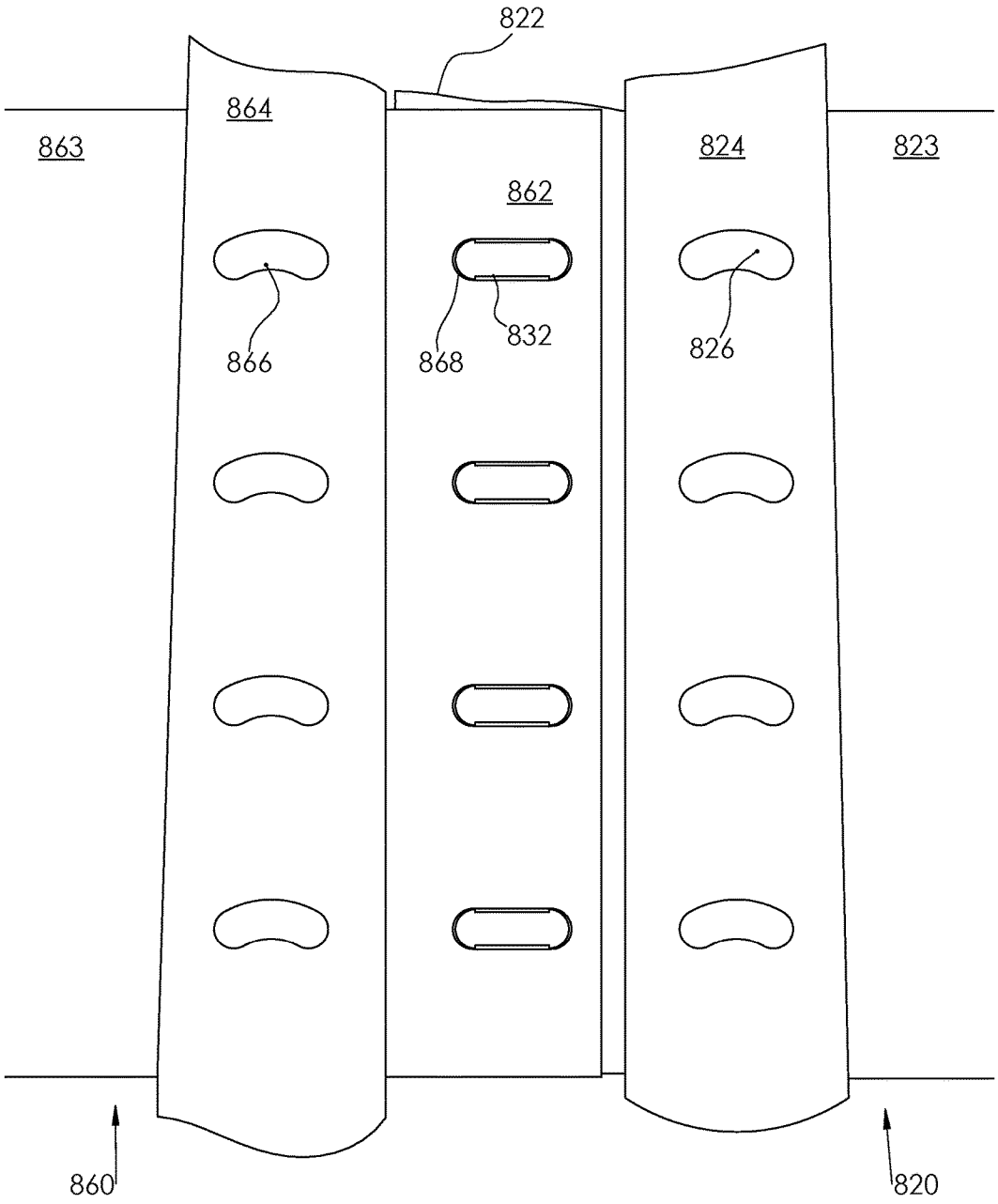
FIG. 9 is an illustration of an exemplary partially assembled seam between two flood barriers.
Figure 10:
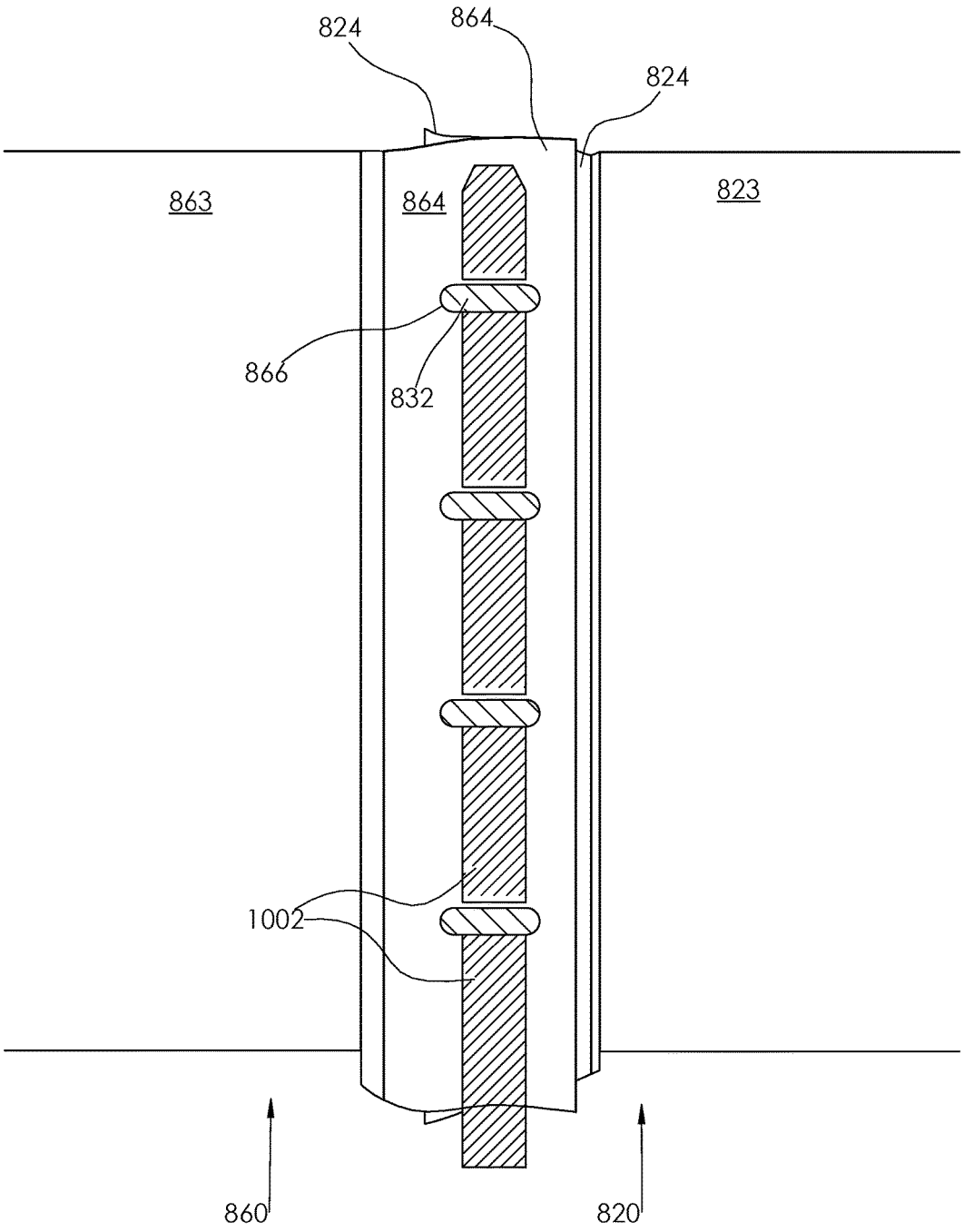
FIG. 10 is an illustration of an exemplary seam after assembly between two flood barriers.

FIG. 8 is an illustration of exemplary ends of two flood barriers before connecting the flood barriers in a seam. A waterproof seam can be constructed between neighboring flood barriers that seals the barriers together to create a longer combined flood barrier. A waterproof seam can be constructed in many ways. As depicted in FIGS. 8-10, one embodiment of such a seam includes interleaving four flaps, two from the ends of each neighboring flood barrier, and then sealing the flaps together with a strip of stiff material fed through a series of regularly spaced posts constructed within one of the flaps that penetrate the remaining stack of flaps.

FIG. 8 illustrates the start of the process for building the seam. The right end of a flood barrier 820 is lying next to the left end of a flood barrier 860. A flap 824 is attached to the main sheet 823 material of barrier 820, and a similar flap 864 is attached to the main sheet 863 material of barrier 860. The flaps 824 and 864 may be made of the same material as the main sheets 823 and 863, and may be of the same thickness as the main sheets material. The flaps may preferably be attached with a watertight seal, such as by welding. In this embodiment, the ends of the main sheets 823 and 863 also act as flaps for the interleaved seam in the same manner as flaps 824 and 864. Alternately, the two end sheets 822 and 862 may be created by attaching two separate pieces of flap material to the end of the main flexible sheet material of the body of the flood barrier.

The bottom flap, in this case sheet 822, has a base 831 for post 832 attached to the upper surface of bottom sheet 822. The post 832 extends upward from the base 831 and away from and perpendicular to the bottom of end sheet 822. The post 832 is wide, with an eyelet 834 in the side of post 832. Flaps 824 and 864 and end sheet 862 have holes 826, 866, and 868, respectively that match the shape and position of the top of post 832. Holes 826, 866, and 868 may be, for example, cut, stamped, or molded into the flap and sheet material. An arrayed series of such posts and holes may be evenly or regularly spaced along the ends of barriers 820 and 860, as depicted in FIG. 8.

FIG. 9 is an illustration of an exemplary partially assembled seam between two flood barriers. In FIG. 9, the barriers 820 and 860 have been slid closer to each other, such that the end sheet 862 lies on top of end sheet 822, and hole 868 has been slid down over the end of post 832. Continuing the construction from FIG. 9, flap 824 is overlaid on top of end sheet 862 with hole 826 sliding over the end of post 832. Then flap 864 is the top layer of the stack, lying on top of flap 824 with hole 866 also slid over the end of post 832.

The resulting stack is depicted in FIG. 10. FIG. 10 is an illustration of an exemplary seam after assembly between two flood barriers and while it illustrates the sheets as not being completely aligned, that is only for illustration purposes. In actual use, the end sheets and flaps would overlap so that one sheet or flap is not visible or are only partly visible below the any end sheet or flap on top. To seal the stack of interleaved flaps, a strip 1002 is fed through the eyelets of the array of posts, including eyelet 834 of post 832. The strip 1002 may be a high-strength fiber band with the effect of sewing the flaps and end sheets together and is initially held together by pressure exerted against the strip 1002 as it sits between the eyelet 834 and the flap 864. The flaps and end sheets would be further locked in place by pressure from water against the barrier. The spacing between the array of posts may depend on the stiffness of strip 1002 such that strip 1002 can maintain sufficient pressure on the stack of flaps between the posts to ensure a watertight seal along the entire length of the seam between barriers 820 and 860.

In another embodiment, different numbers of flaps/end sheets may be used. For example, a total of three flaps could be used where the one barrier has one flap with posts and one flap with holes, and the neighboring barrier has only a single flap with holes. Fewer flaps may be sufficient for barriers with a shorter height 256 that need not withstand water pressure as high. Alternately, flood barriers with taller height 256 may have, for example, five or six flaps to be able to ensure a watertight seal under higher water pressure. A stack of six flaps could have three flaps (or two flaps plus a main sheet layer) on each side of the seam. In some embodiments, one end of each barrier may have an array of posts, while the opposite end of each barrier may only have holes, such that a series of barriers can be daisy-chained together to an create arbitrarily long barrier out of a series of identical standard length barriers.

Conditional language used herein, such as, among others, "can," "could," "might," "may," "e.g.," and the like, unless specifically stated otherwise, or otherwise understood within the context as used, is generally intended to convey that certain examples include, while other examples do not include, certain components, elements, and/or steps. Thus, such conditional language is not generally intended to imply that components, elements, and/or steps are in any way required for one or more examples or that one or more examples necessarily include logic for deciding, with or without author input or prompting, whether these components, elements, and/or steps are included or are to be performed in any particular example. The terms "comprising," "including," "having," and the like are synonymous and are used inclusively, in an open-ended fashion, and do not exclude additional elements, components, acts, operations, and so forth. Also, the term "or" is used in its inclusive sense (and not in its exclusive sense) so that when used, for example, to connect a list of elements, the term "or" means one, some, or all of the elements in the list.

In general, the various components and processes described above may be used independently of one another, or may be combined in different ways. All possible combinations and sub-combinations are intended to fall within the scope of this disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed examples. The example systems and components described herein may be configured differently than described. For example, elements may be added to, removed from, or rearranged compared to the disclosed examples.

While different figures may represent alternate embodiments, identical element numbers used in different figures are intended to represent similar elements.

While certain examples or illustrative examples have been described, these examples have been presented by way of example only, and are not intended to limit the scope of the subject matter disclosed herein. Indeed, the novel methods and systems described herein may be embodied in a variety of other forms. The accompanying claims and their equivalents are intended to cover such forms or modifications as would fall within the scope and spirit of certain of the subject matter disclosed herein.

What is claimed:

1. A flood barrier, comprising:

a wall including a first flexible sheet and a plurality of parallel wall support members embedded in the first flexible sheet;

a base including a second flexible sheet and a plurality of parallel base support members embedded in the second flexible sheet;

a hinge connecting the base to the wall;

a limiter configured to hold the wall up relative to the base in an erected configuration;

at first tether from the base to the wall on a flooding side of the flood barrier preventing the wall from opening beyond a desired angle at the hinge between the wall and the base, the first tether having a first end coupled to a protected side of a first support member of the plurality of wall support members; and wherein the flood barrier provides flood protection when in the erected configuration, and wherein the flood barrier is capable of closing to a collapsed configuration by bending at the hinge.

2. The flood barrier of claim 1, wherein the limiter includes at least one angle support member configured to be fixed to the flooding side of the flood barrier at the base and at the wall in the erected configuration, wherein the angle support member helps fix the angle at the hinge between the wall and the base.

3. The flood barrier of claim 2, wherein the angle support member is fixed to the wall at least in part by fixing the angle support member to one of the plurality of wall support members or is fixed to the base at least in part by a fixing the angle support member to one of the plurality of base support members.

4. The flood barrier of claim 3, wherein the first flexible sheet is formed of a first series of sheets where a first batten pocket is formed by overlapping a first two sheets among the first series of sheets and sealing the first two sheets together at two sealed points leaving a gap between the two sealed points large enough for a corresponding first batten, wherein the second flexible sheet is formed of a second series of sheets where a second batten pocket is formed by overlapping a second two sheets among the second series of sheets and sealing the second two sheets together at two sealed points leaving a gap between the two sealed points large enough for a corresponding second batten, and wherein the angle support member is fixed to the first batten through one sheet of the first two sheets at the first batten pocket and the angle support member is fixed to the second batten through one sheet of the second two sheets at the second batten pocket.

5. The flood barrier of claim 2, wherein the angle support member is further configured to be unfixed from at least one of the wall and the base to enable the barrier to transition from erected configuration to collapsed configuration.

6. The flood barrier of claim 1, wherein each of the wall support members include a first batten, wherein each of the first battens are held in place in the wall at least in part by a corresponding first batten pocket in the first flexible sheet.

7. The flood barrier of claim 6, wherein each of the first batten pockets in the first flexible sheet are uniformly spaced along a length of the wall.

8. The flood barrier of claim 6, wherein the first flexible sheet is formed of a series of sheets and each first batten pocket is formed by overlapping two sheets among the series of sheets and sealing the two sheets together at two sealed points leaving a gap between the two sealed points large enough for the first batten corresponding to the first batten pocket.

9. The flood barrier of claim 8, wherein the first tether is fixed to a first batten of the plurality of wall support members through at least one sheet of the two sheets at the corresponding first batten pocket.

10. The flood barrier of claim 1, wherein each of the base support members include a second batten, wherein each of the second battens are held in place in the base at least in part by a corresponding second batten pocket in the second flexible sheet.

11. The flood barrier of claim 10, wherein each of the second batten pocket in the second flexibly sheet are uniformly spaced along a length of the base.

12. The flood barrier of claim 10, wherein the second flexible sheet is formed of a series of sheets and each second batten pocket is formed by overlapping two sheets among the series of sheets and sealing the two sheets together at two sealed points leaving a gap between the two sealed points large enough for the second batten corresponding to the second batten pocket.

13. The flood barrier of claim 12, wherein the first tether is fixed to a second batten of the plurality of base support members through at least one sheet of the two sheets at the second batten pocket corresponding to the second batten.

14. The flood barrier of claim 1, further configured to roll up from the collapsed configuration into a rolled configuration, such that the wall support members and the base support members are positioned perpendicular to a direction of rolling.

15. The flood barrier of claim 14, further comprising roll ties, wherein the roll ties are configured to wrap around the barrier when in the rolled configuration to retain the barrier in the rolled configuration, and wherein the roll ties include handles configured to aid carrying the barrier when in the rolled configuration.

16. The flood barrier of claim 1, further comprising an array of posts attached to a first end of the flexible sheet, and a first array of holes in a second end of the flexible sheet, wherein the posts and holes are configured for forming a seam with neighboring flood barriers.

17. The flood barrier of claim 16, wherein the first end of the flexible sheet further comprises a first flap with a second array of holes, and the second end of the flexible sheet comprises a second flap with a third array of holes, wherein the posts and the first, second, and third arrays of holes are configured for forming a seam with neighboring flood barriers.

18. The flood barrier of claim 1, wherein the wall support members and base support members comprise fiberglass.

19. The flood barrier of claim 1, wherein the first end of the first tether is coupled to the protected side of the first support member by a fastener through the first support member and a washer on the protected side of the first support member.

20. The flood barrier of claim 1, wherein the first tether further having a second end coupled to a bottom side of a second support member of the plurality of base support members by a fastener through the second support member and a washer on the bottom side of the second support member.

21. The flood barrier of claim 1, further comprising:

a second tether from the base to the wall on the flooding side of the flood barrier preventing the wall from opening beyond the desired angle at the hinge between the wall and the base, the second tether having a first end coupled to the protected side of the first support member and a second end being coupled to a bottom side of a second support member of the plurality of base support members.

* * * * *